United States Patent [19]

Kuo

[11] Patent Number: 4,813,551

[45] Date of Patent: Mar. 21, 1989

[54] COMPOSITIVE T-HANDLE HEXAGON KEY WRENCH SET

[76] Inventor: Teng-Tang Kuo, 7 Kung Yuang Rd., Hsi Chih, Taipei Hsien, Taiwan

[21] Appl. No.: 83,200

[22] Filed: Aug. 10, 1987

[51] Int. Cl.[4] ..... A47F 7/00

[52] U.S. Cl. ..... 211/70.6; 206/377

[58] Field of Search ..... 211/69, 70.6, 189; 206/372, 376, 377, 379

[56] References Cited

U.S. PATENT DOCUMENTS 2,510,260 6/1950 Searfoss ..... 206/377
2,539,276 1/1951 Schmeling ..... 211/69 X
2,974,804 3/1961 Maro ..... 211/70.6
3,379,315 4/1968 Broadwin ..... 211/189 X

*Primary Examiner*—Robert W. Gibson, Jr.
*Attorney, Agent, or Firm*—Wenderoth, Lind & Ponack

[57] ABSTRACT

The T-handle hexagonal key wrench set and base can be disassembled and piled up before use, thus decreasing the volume thereof. This feature is especially suited for mass transportation and saves transportation costs. Also, each bearing plate is securely interlockable by use of interconnecting insertion plates. These interlocking insertion plates allow quick, secure assembly into a functional "ㄹ" shape.

6 Claims, 2 Drawing Sheets

COMPOSITIVE T-HANDLE HEXAGON KEY WRENCH SET

BACKGROUND OF THE INVENTION

1. Field of the Invention

The present invention is related to a composite T-handle hexagonal key wrench set which is constructed with an upper bearing plate, a middle bearing plate, and a lower bearing plate. The three plates each have perpendicular edges which extend vertically from the bearing plates and can be pressed to form several pieces of interlockable insertion plates which enable the three bearing plates to be connected to form a tool base. T-handle hexagon wrenches can be inserted into appropriate holes in the tool base. The base can be disassembled and the three bearing plates piled up to decrease the volume of the wrench key set.

2. Description of the Prior Art

One of the conventional T-handle hexagonal wrench sets (as shown in FIG. 5) which is different from other conventional T-handle hexagon wrench sets, has a hexagonal wrench which is enclosed by a T-shaped plastic handle for more convenience for handling and pressing and is normally composed by different sizes of wrench inserted into a wrench set base as shown in FIG. 5; the conventional wrench base is constructed as "ㄹ" shape stationary type, a series of holes in different sizes are positioned on the base for different sizes of wrenches to be inserted in position.

Because of the wrench base is formed by "ㄹ" -shaped solid, the volume of the wrench set is very great after several pieces of the wrench set are inserted into the wrench set base. If the set then is to be packed, especially by the manufacturor or distributor, the great volume of the wrench sets necessitates higher transportation fee, thus increasing the unit prices of the conventional T-handle hexagon key wrench set.

SUMMARY OF THE INVENTION

The main object of the present invention is to provide a composite T-handle hexagonal key wrench set base which can be disassembled and packed up after using. Also, the wrench set base parts can be packed up together with the wrench set for a resulting decrease to half the volume of the conventional one. Therefore, the delivery quantities can be increased for each bundle with resultant savings in transportation cost for the manufacturor and distributor, by which the unit cost of the wrench set base will be decreased correspondingly.

Another object of the present invention is to provide a T-handle hexagon key wrench set base which is convenient to assemble and is formed as a stable construction. When the wrench is transported over a long distance it can be disassembled to decrease volume and is, thus, very convenient for the user.

DESCRIPTION OF THE PREFERRED EMBODIMENT

Figure 1:
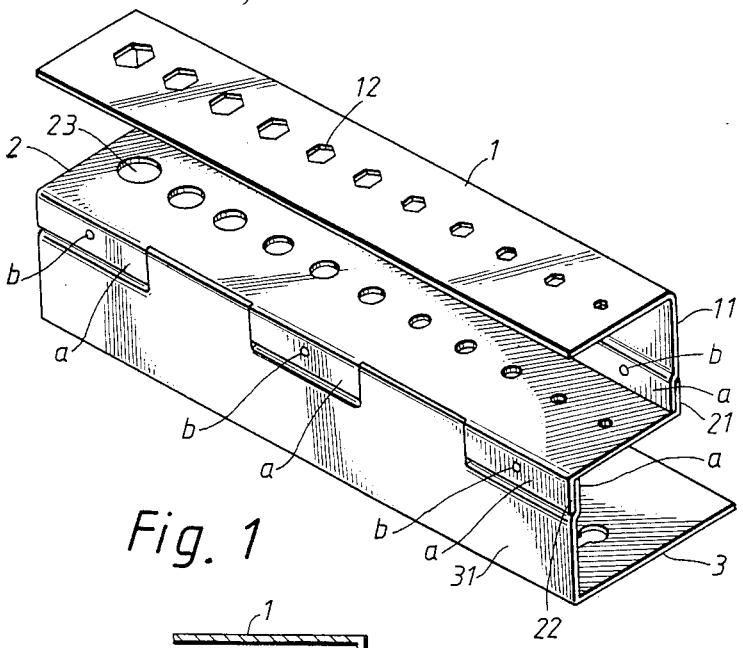
FIG. 1 is a perspective view of the T-handle hexagonal key wrench set of the present invention.
Figure 2:
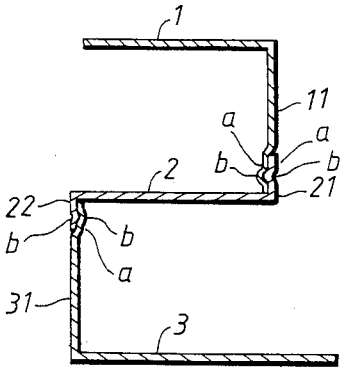
FIG. 2 is a cross section of the T-handle key wrench set of the present invention.
Figure 3:
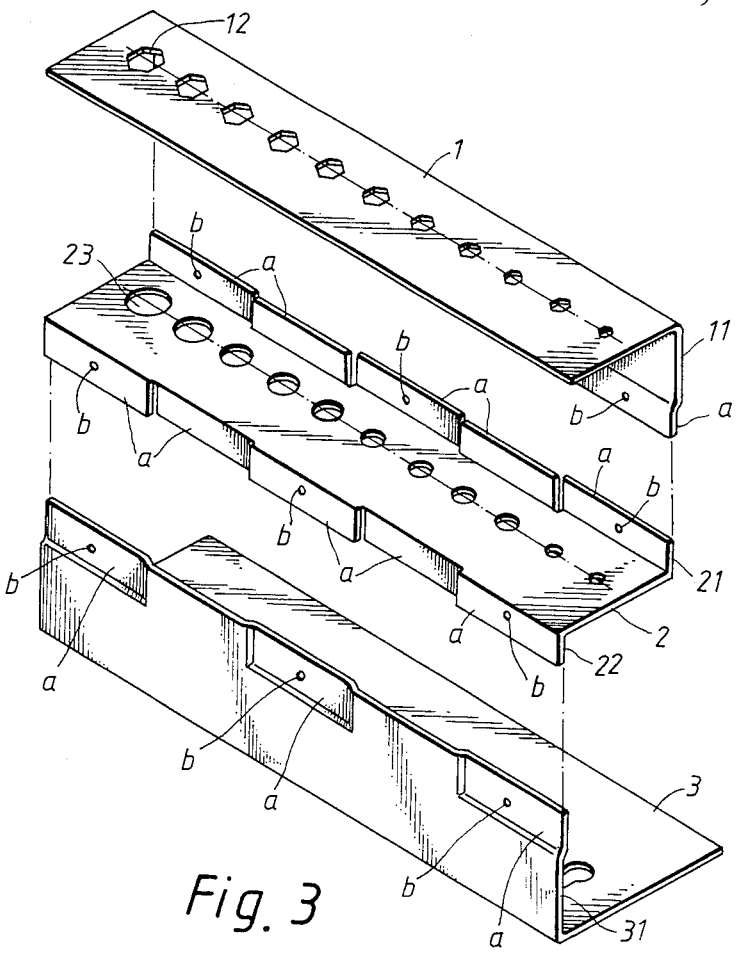
FIG. 3 is an exploded perspective view of the T-handle hexagonal key wrench set of the present invention prior to assembly.

As shown in FIG. 1, 2, and 3, the wrench set of the present invention is constructed by upper bearing plate 1, middle bearing plate 2, and lower bearing plate 3.

FIG. 2 shows the upper bearing plate which is made with a substantially perpendicular edge bent downwardly to extend a certain length as a straight edge 11 to form a "ㄱ" shape. A series of different sizes of hexagonal holes 12 are positioned in the top of the upper bearing plate 1 to provide distance positions for the T-handle hexagonal key wrenches to be inserted. Two longitudinal edges of the middle bearing plate 2 are bent perpendicular upwardly and downwardly and extend certain length to form the straight edges 21, 22, thus forming a "ㄹ" shape. Also, a series of hexagonal holes 23 are positioned, corresponding to the hexagonal holes 12 of the upper bearing plate, in the surface of the middle bearing plate 2. And the longitudinal edge of the lower bearing plate 3 is bent perpendicularly and extends to a certain length for defining a vertical leg or a straight edge 31 to form an "ㄴ" shape. The straight edge 11 of the upper bearing plate 1 and the vertical leg or straight edge 31 of the lower bearing plate 3 are connected with the straight edges 21, 22 of the middle bearing plate, respectively, to form a stable "ㄹ"-shaped wrench set.

As shown in FIG. 3, the connecting edges of each of the bearing plates are pressed into several pieces of interlockable insertion plates a at distances which are predetermined so as to enable both edges of the interlockable insertion plates a to be interlocked respectively. Thus, both connecting straight edges of two bearing plates are connected tightly together by the interlocking of both sets of interlockable insertion plates a as shown in FIG. 1. The insertion plates a are, for example, pressed concave edges inserted correspondingly to convex edges, and, thus, the bearing plates are connected securely. Also, some of the insertion plates a may have interlockable projections b which further ensure a secure connection between respective bearing plates.

Figure 4:
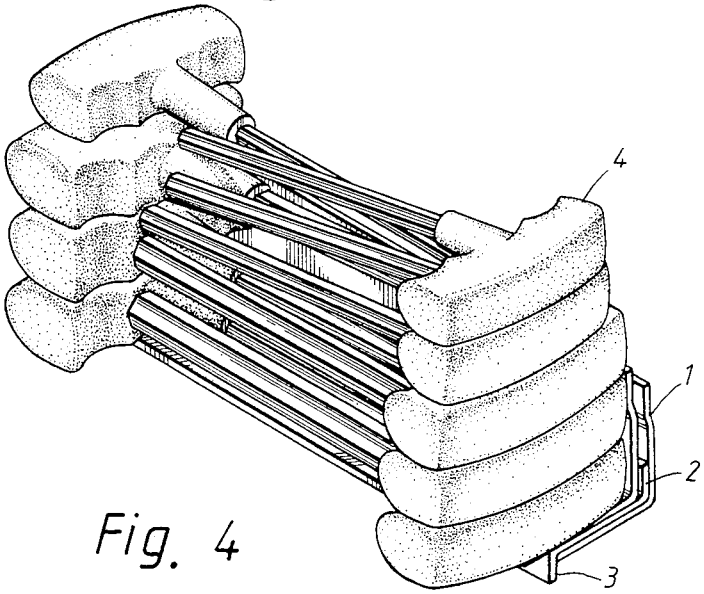
FIG. 4 is a perspective view of the T-handle hexagonal key wrench set of the present invention when it is disassembled and piled up ready for shipping in compact form.
Figure 5:
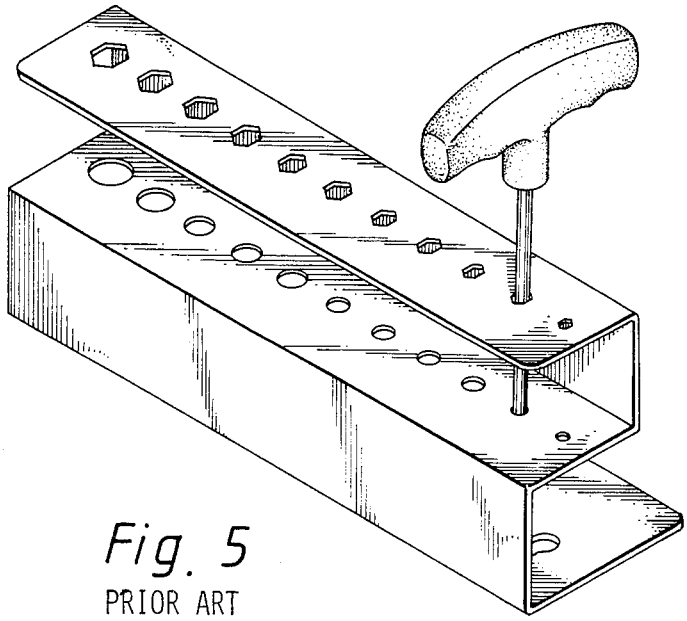
Fig. 5 PRIOR ART
FIG. 5 is a perspective view of the PRIOR ART T-handle hexagonal key wrench set which can not be disassembled.

As shown in FIG. 4, the hexagonal key wrench set base of the present invention comprises an upper bearing plate 1, a middle bearing plate, 2 and a lower bearing plate 3. Thus, before assembly it can be piled up with the upper middle, and lower bearing plates nested longitudinally to form the space for the T-handle hexagon key wrench set 4 to be piled up on top of the three nested bearing plates 1, 2, 3 (as seen in FIG. 4). Therefore, the volume of the wrench set and base is decreased before assembly as compare with the conventional wrench set base shown in FIG. 5.

As shown in FIG. 3, the wrench set base comprises an upper bearing plate 1, middle bearing plate 2, and lower bearing plate 3 to form a "ㄹ" shape after assembling. When assembled the hexagonal holes 12 and round holes 23 positioned at the upper bearing plate 1 and middle bearing plate 2, respectively enable a T-handle hexagonal wrench set 4 to be inserted and fixedly held. The loading of the wrench set 4 does not apply any significant forces directly to the wrench set base.

Therefore, the loading of the wrenches does not affect the connections of the various bearing plates 1, 2, 3 of the wrench set base.

I claim:

1. A composite base for a hexagonal key wrench set, said base comprising:

a substantially L-shaped lower bearing plate having vertical and horizontal legs;

first connecting means at the free end of said vertical leg of said lower bearing plate;

a substantially flat middle bearing plate having a pair of spaced opposed edges;

a pair of second connecting means, one each of said pair of second connecting means at each one of said pair of spaced opposed edges of said middle bearing plate;

a first plurality of through holes in said middle bearing plate for receiving a hexagonal key wrench therethrough;

a substantially L-shaped upper bearing plate having vertical and horizontal legs;

third connecting means at the free end of said vertical leg of said upper bearing plate;

a second plurality of through holes in said horizontal leg of said upper bearing plate; and said first connecting means being connectable with one of said pair of second connecting means, said third connecting means being connectable with the other one of said pair of second connecting means, said first plurality of through holes in said middle bearing plate being aligned with said second plurality of through holes in said upper bearing plate when said third connecting means is connected to said other one of said second connecting means for receiving a plurality of hexagonal key wrenches therethrough.

2. A device as in claim 1, wherein each said first and third connecting means includes a first plurality of interlockable insertion plates, and said second connecting means includes a second plurality of interlockable insertion plates.

3. A device as in claim 2, wherein each of said first and second plurality of interlockable insertion plates includes a plurality of interlockable projections.

4. In combination, a plurality of hexagonal key wrenches and a base for receiving said plurality of hexagonal key wrenches, said base comprising:

a substantially L-shaped lower bearing plate having vertical and horizontal legs;

first connecting means at the free end of said vertical leg of said lower bearing plate;

a substantially flat middle bearing plate having a pair of spaced opposed edges;

a pair of second connecting means, one each of said pair of second connecting means at each one of said pair of spaced opposed edges of said middle bearing plate;

a first plurality of through holes in said middle bearing plate for receiving a hexagonal key wrench therethrough;

a substantially L-shaped upper bearing plate having vertical and horizontal legs;

third connecting means at the free end of said vertical leg of said upper bearing plate;

a second plurality of through holes in said horizontal leg of said upper bearing plate; and said first connecting means being connectable with one of said pair of second connecting means, said third connecting means being connectable with the other one of said pair of second connecting means, said first plurality of through holes in said middle bearing plate being aligned with said second plurality of through holes in said upper bearing plate when said third connecting means is connected to said other one of said second connecting means for receiving said plurality of hexagonal key wrenches therethrough.

5. A device as in claim 4, wherein each said first and third connecting means includes a first plurality of interlockable insertion plates, and said second connecting means includes a second plurality of interlockable insertion plates.

6. A device as in claim 5, wherein each of said first and second plurality of interlockable insertion plates includes a plurality of interlockable projections.

* * * * *